US005820478A

United States Patent [19]

Wood et al.

[11] Patent Number: 5,820,478

[45] Date of Patent: Oct. 13, 1998

[54] POWERED TILTABLE PLATFORM

[75] Inventors: Darrel John Wood, Victoria; David Matthew Dent, North Vancouver, both of Canada

[73] Assignee: Slopemaster Golf, Inc., Vancouver, Canada

[21] Appl. No.: 891,480

[22] Filed: Jul. 11, 1997

[51] Int. Cl.[6] ..... A63B 69/36

[52] U.S. Cl. ..... 473/279

[58] Field of Search ..... 473/279

[56] References Cited

U.S. PATENT DOCUMENTS

| | | | |
|---|---|---|---|
| 3,633,918 | 1/1972 | Smiley | 273/195 B |
| 4,875,684 | 10/1989 | Benilan | 273/195 B |
| 5,340,111 | 8/1994 | Froelich | 273/195 B |
| 5,358,251 | 10/1994 | Ashton | 273/195 B |
| 5,470,074 | 11/1995 | Hotchkiss et al. | 273/195 B |
| 5,527,042 | 6/1996 | Spriddle | 472/279 |
| 5,549,522 | 8/1996 | Chang | 473/279 |
| 5,558,334 | 9/1996 | Roche | 473/279 |
| 5,720,670 | 2/1998 | Oxley et al. | 473/279 |

*Primary Examiner*—George J. Marlo
*Attorney, Agent, or Firm*—Kolisch Hartwell Dickinson McCormack & Heuser

[57] ABSTRACT

A tiltable platform suitable for a golf practice stand provides a rigid stable platform and is easily tiltable in all directions. The platform has a first guide track and a second guide track arranged in a cruciform configuration thereunder with a centre intersection. A base is provided under the platform and supports a first frame member under the first guide track and a second frame member under the second guide track with opposite sloped linkage arms. First and second linear actuators tilt the platform in two planes representing the first guide track and the second guide track by pivoting the linkage arms and an operating control for the actuators permits adjustment of the slope of the platform.

23 Claims, 8 Drawing Sheets

POWERED TILTABLE PLATFORM

FIELD OF THE INVENTION

The present invention relates to a platform which can be tilted in all directions from the horizontal. More specifically, the present invention relates to a tilting platform for use as a golf practice tee to allow a golfer to adjust the slope of the platform in any direction.

DESCRIPTION OF RELATED ART

Powered tilted platforms have a number of uses for both industry and sports activities. In some fields they can be used for levelling when a platform rests on uneven ground and it is necessary to have a level platform. Another use is for mounting a sighting device and tilting the platform to aim the device toward a particular target.

One of the uses for tiltable platforms relates to golf practice platforms. Most golf driving ranges have platforms, generally horizontal, and with artificial turf for practising golf shots. There are also tiltable golf platforms available. These tiltable platforms permit the user to set a platform slope to simulate a wide variety of uneven golf ball lies. Some platforms are powered by hydraulic jacks such as U.S. Pat. Nos. 5,340,111 to Froelich or 5,470,074 to Hotchkiss et al or mechanical adjusting mechanisms such as that shown by Ashton in U.S. Pat. No. 5,358,251, Chang in U.S. Pat. No. 5,549,522 and Roche in U.S. Pat. No. 5,558,334. Another golf practice platform as shown by Spriddle provides a mechanism whereby the golfer can change the incline of the platform by using his own weight to set the incline.

Most of these devices do not have sufficient platform rigidity for a user to concentrate on swinging a golf club. It is important to have a stable platform so that a golfer's swing is not effected. If the platform is unstable, then the user concentrates more on keeping his balance rather than hitting the ball. Furthermore, some of these devices require a considerable depth below the platform to permit the tilting movement and thus either results in high platforms, or requires the platforms to be installed in pits or trenches.

SUMMARY OF THE INVENTION

It is an aim of the present invention to provide a powered tiltable platform that may be used in industry or sports, and is particularly useful for a golf practice platform. The platform may be tilted by the golfer to allow a variety of degrees of slope to simulate the various uphill, downhill and left and right side hill lies of a golf ball. In one embodiment the platform is tilted by a joy stick control positioned on one side of the platform operated simply by contact with a golf club or the foot of a golfer. Thus, it is a simple matter for a golfer to stand on the platform and set the slope. In another embodiment the platform has synthetic grass panels for lefthand and righthand hitters to support a golf ball at almost any slope. In a still further embodiment, stabilizers are provided to dampen the tilting movement of the platform so that it does not rock, tremble or sway when being moved from one position to another and when moved to a position retains that position without shaking.

In one embodiment of the present invention there is provided an improved golf practice tiltable platform which can be used by golf instructors as a training tool for teaching students a variety of golf shots from sloped lies. The hitting surface on the platform is preferably a deep pile fibre synthetic grass which supports the ball or may have a surface to simulate sand traps. The tiltable platform can be placed in the open and in another embodiment may be incorporated with a computerized golf course program utilizing a padded screen. The computer program simulating the golf course sets the slope of the platform to simulate a fairway or rough ball lie on the golf course.

In the case of a powered tiltable platform for golf practice, the unit may be made for home use so that it can be combined with a hitting net for backyard use. The unit may also be portable and moved from place to place. If positioned at golf driving ranges, then the system may be hooked up to a coin or token operated timing device for users.

The present invention provides a powered tiltable platform comprising a platform having a first guide track and a second guide track arranged in a cruciform configuration thereunder with a centre intersection; a base positioned underneath the platform having support members underneath the first guide track and the second guide track of the platform; a first frame member beneath and in line with the first guide track retained to the platform and slidable relative to the platform in a first path parallel to the first guide track; first opposite sloped linkage arms joining the first frame member to the support members of the base on each side of the centre intersection of the platform; a first adjustable linear actuator on one side of the first frame member, the first actuator having a fully extended position when the first sloped linkage arms tilt the platform to a maximum slope away from the first actuator and a fully retracted position when the first sloped linkage arms tilt the platform to a maximum slope towards the first actuator; a second frame member beneath and in line with the second guide track, retained to the platform and slidable relative to the platform in a second path parallel to the second guide track; second opposite sloped linkage arms joining the second frame member to the support members of the base on each side of the centre intersection of the platform; a second adjustable linear actuator on one side of the second frame member, the second actuator having a fully extended position when the second sloped linkage arms tilt the platform to a maximum slope away from the second actuator, and a fully retracted position when the second sloped linkage arms tilt the platform to a maximum slope towards the second actuator, and an operating control for the first actuator and the second actuator to adjust the slope of the platform.

In one embodiment, the present invention provides a powered tiltable platform comprising a platform having a central pivotal connection with a first guide track and a second guide track arranged in a cruciform configuration underneath the platform, the central pivotal connection being at the centre of the cruciform configuration; a base positioned underneath the platform having support members underneath the first guide track and the second guide track of the platform and a post support extending up from the base to the central pivotal connection to support the platform for tilting in any direction; a first movable frame beneath and in line with the first guide track, having a first guide at each end of the first frame to engage the first guide track on each side of the central pivotal connection; first sloped opposite linkage arms joining the first frame to the support members of the base on each side of the post support; a first adjustable linear actuator on one side of the first frame, the first actuator having a fully extended position when the first guide at each end of the first frame tilts the platform to a maximum slope away from the first actuator, and a fully retracted position when the first guide at each end of the first frame tilts the platform to a maximum slope toward the first actuator; a second movable frame, beneath and in line with the second guide track, having a second guide at each end of the second frame to engage the second guide track on each side of the central pivotal connection; second opposite sloped linkage arms joining the second frame to the support members of the base on each side of the post support; a second adjustable linear actuator on one side of the second frame, the second actuator having a fully extended position when the second guide at each end of the second frame tilts the platform to a maximum slope away from the second actuator, and a fully retracted position when the second guide at each end of the second frame tilts the platform to a maximum slope toward the second actuator, and an operating control for the first actuator and the second actuator to adjust the slope of the platform.

BRIEF DESCRIPTION OF THE DRAWINGS

In drawings which illustrate embodiments of the present invention.

DESCRIPTION OF THE PREFERRED EMBODIMENTS

Figure 1:
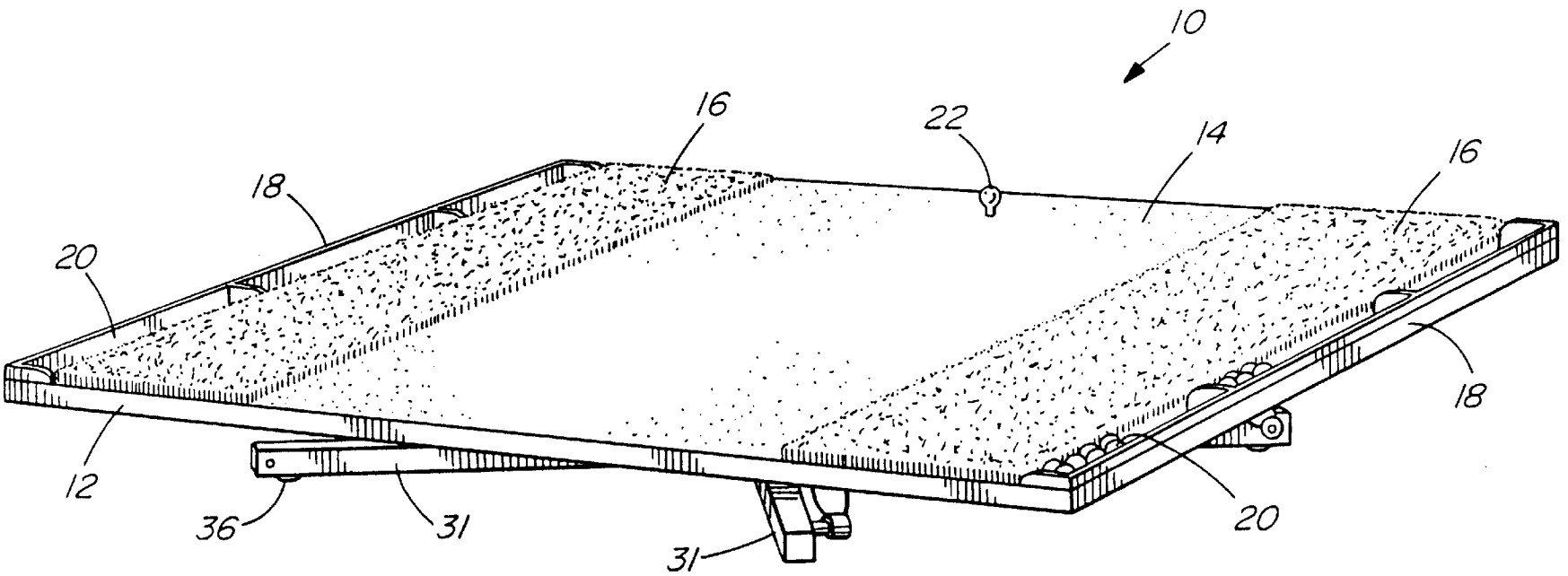
FIG. 1 is a perspective view showing a powered tiltable platform for golf practice according to one embodiment of the present invention.

The powered tiltable platform of the present invention may be made for mounting equipment or other uses. The embodiment shown in FIG. 1 is a powered tiltable platform 10 for golf practice. A platform 12 has a stance portion 14 with short fibre synthetic grass thereon, suitable for a golfer to stand on. Outer panels 16 of deep pipe fibre matting on both sides of the stance portion 14 support a golf ball at any tilt angle. Thus, the platform may be used by lefthand and righthand golfers. At the outer edges 18 of the platform 12 a series of troughs 20 are provided for golf balls. At one side of the platform 12 in the stance portion 14 is a joy stick control 22 for tilting the platform 12. Operation may easily be accomplished by pushing the joy stick 22 in any direction using a golf club or with the foot of a golfer.

Figure 2:
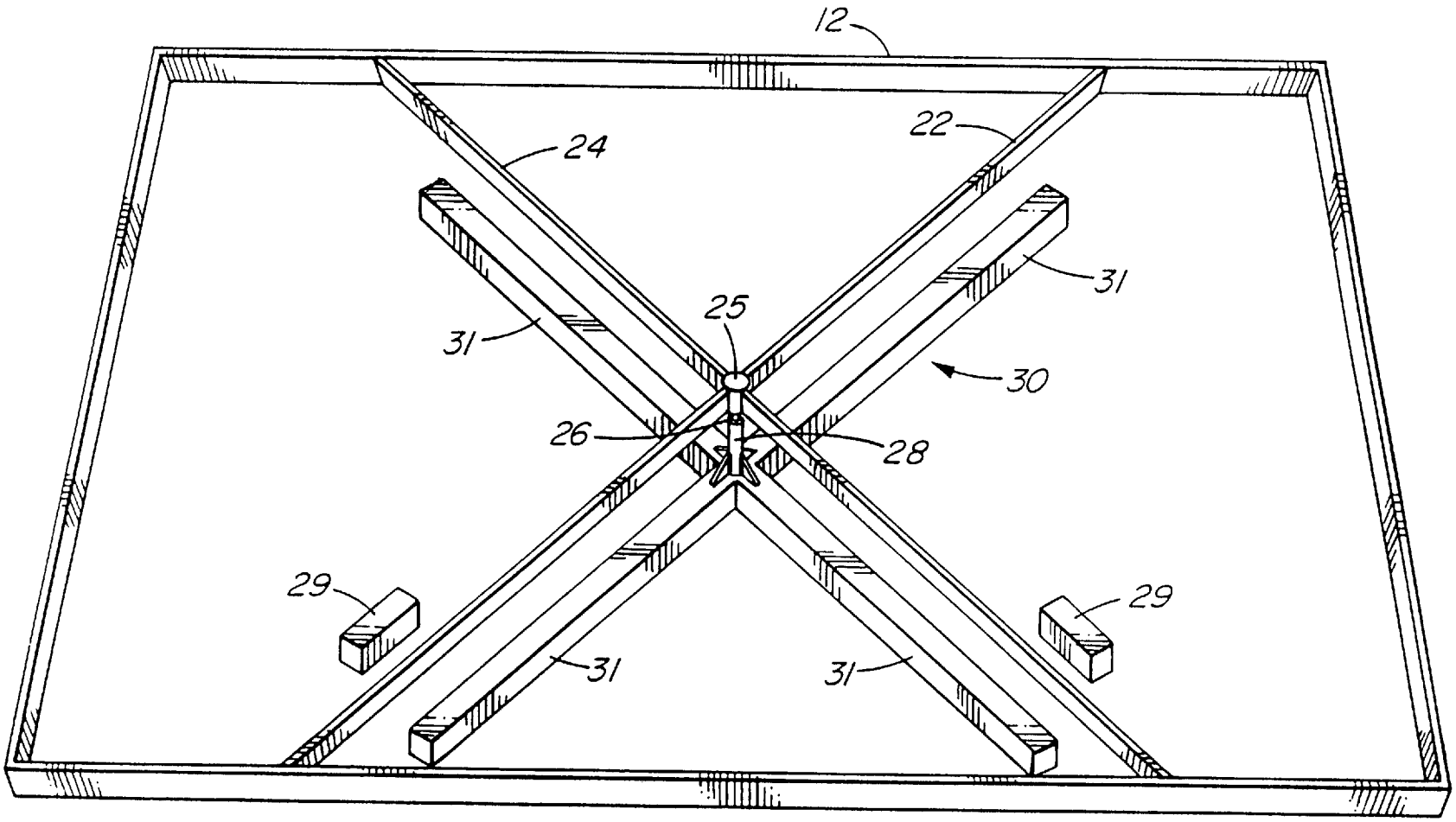
FIG. 2 is a perspective view of the underside of the platform shown in FIG. 1 with cruciform guide tracks and cruciform support members on the base, the tilting mechanism being omitted.

As seen in FIG. 2, the top platform 12 has a frame on which is supported the platform itself. The frame is preferably made from aluminum or steel and the platform may be aluminum, plastic, wood or other suitable material with the synthetic fibre matting placed on top. Incorporated in the frame of the platform 12 are a first guide track 22 and a second guide track 24 arranged in a cruciform configuration extending from the outside of the frame and crossing at a centre intersection 25 with a pivotal connection 26 shown therein. In another embodiment, the pivotal connection may be omitted. The cruciform configuration is preferably divided into 90° angles. The pivotal connection 26 joins to a post support 28 which in turn is attached to a base 30. In the embodiment shown, the base 30 has a cruciform configuration with base members 31 extending parallel and below the first guide track 22 and the second guide track 24.

Figure 3:
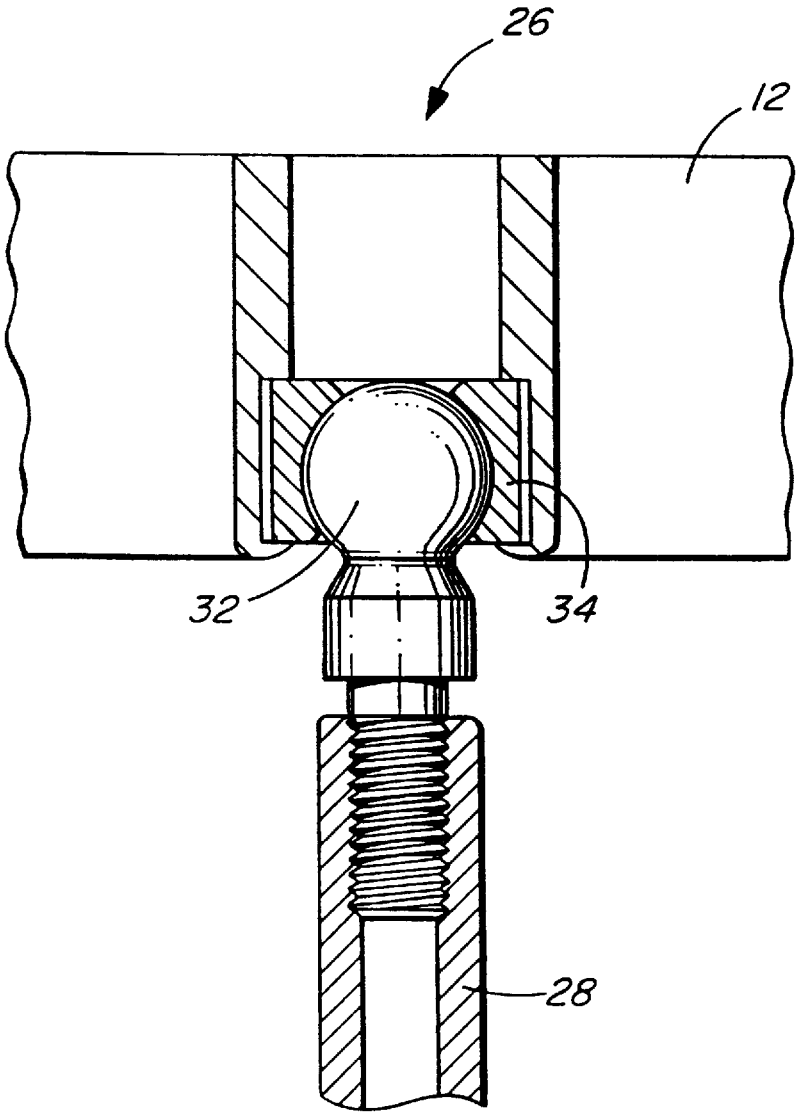
FIG. 3 is a partial sectional view showing the pivotal connection between the post support and the underside of the flat platform.

As shown in FIG. 3, the pivotal connection 26 comprises a ball joint 32 attached to the top of the support post 28 engaging in a socket 34 in the platform 12. Thus, the platform 12 can be tilted in all directions about the support post 28.

Slope detectors 29 are shown in FIG. 2 positioned on the underside of the platform 12 to measure the slope of the platform in two planes representing the first guide track 22 and the second guide track 24. The slope detectors 29 are inclinometers as shown in FIG. 2. One or two inclinometers may be used to provide a signal in both planes which may be used with a programmed slope. In another embodiment, one or two potentiometers are provided integral with the actuators.

Figure 4:
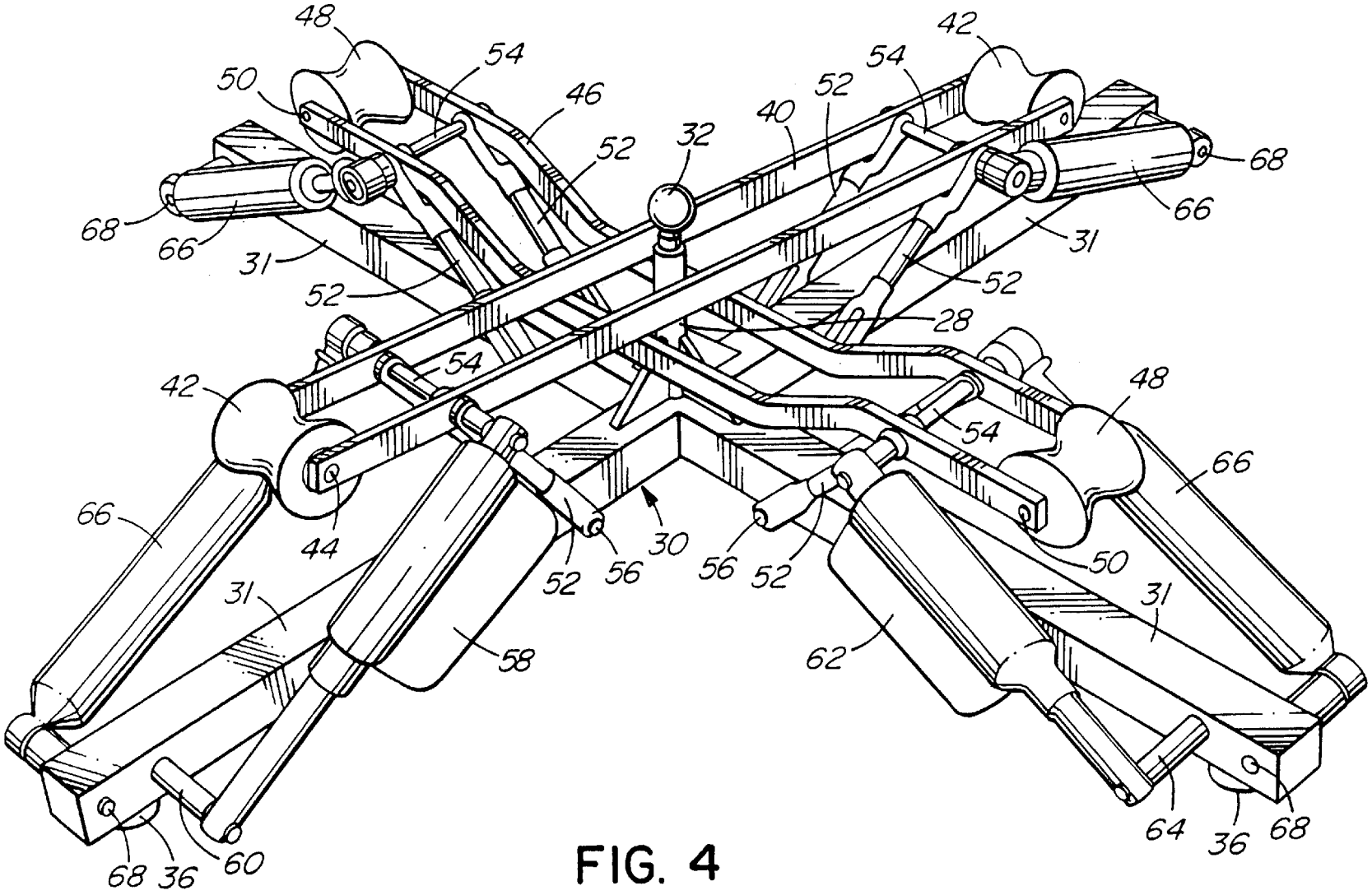
FIG. 4 is an isometric view showing one embodiment of the tilting mechanism for the tiltable platform.

One embodiment of a tilting mechanism is shown in FIG. 4 having a base 30 with cruciform support members 31 and height adjustable pads 36 at the end of each of the support members 31. The adjustable pads 36 permit the platform 12 to be levelled on the ground particularly if there is an uneven surface thereunder.

The tilting mechanism has a first movable frame 40 which has a pair of linear arms parallel to each other and with concave rubber rollers 42 at each end. The rollers 42 are free to rotate on pins 44 extending between the two arms of the first movable frame 40. The rollers 42 of the first movable frame 40 are aligned with and rotate on the first guide track 22 underneath the platform 12. Because the rollers 42 are concave, they do not move out of the tracks 22. A second movable frame 46 has two arms similar to the first movable frame 40 but have depressed sections in the centre so they do not interfere with the arms of the first movable frame 40. The second movable frame 46 is arranged in a cruciform configuration with a first movable frame 40 and has concave rubber rollers 48 free to rotate on pins 50 at the ends of the arms of the second movable frame 46. The rollers 48 are aligned with and rotate on the second guide track 24 underneath the platform 12.

Two pairs of linkage arms 52 are connected on each side of the first movable frame 40 and the second movable frame 46. The pairs of linkage arms 52 are sloped in opposite directions and have top connection shafts 54 between the arms of the first movable frame 40 and the arms of the second movable frame 46. The top connection shafts 54 are positioned adjacent to the rollers 42,48 of the frames 40 and 46. The pairs of linkage arms 52 extend downward from the arms of the movable frames 40,46 and slope inwards in opposite directions from each other and are attached by lower connection pins 56 to the support members 31 of the base 30. This configuration is shown in more detail in FIGS. 5, 6 and 7. The pairs of linkage arms 52 are substantially the same for the first movable frame 40 and the second movable frame 46 and permit the frames to tilt in separate planes underneath the platform 12. A first linear actuator 58 extends from one of the shafts 54 on one side of the first frame 40 to a pin connection 60 at an end of the adjacent support member 31 forming the base 30. Similarly, a second linear actuator 62 extends from one of the shafts 54 on one side of the second frame 46 to a pin connection 64 at the end of the adjacent support member 31 forming the base 30. In order to provide a vibration free movement of the platform and to retain the platform firm and stationary when not tilting, dampers 66 extend from the shafts 54 supporting the linkage arms 52 on both sides of the first movable frame 40 and the second movable frame 46 extending down to pins 68 at the end of the support members 31 forming the base 30.

Figure 5:
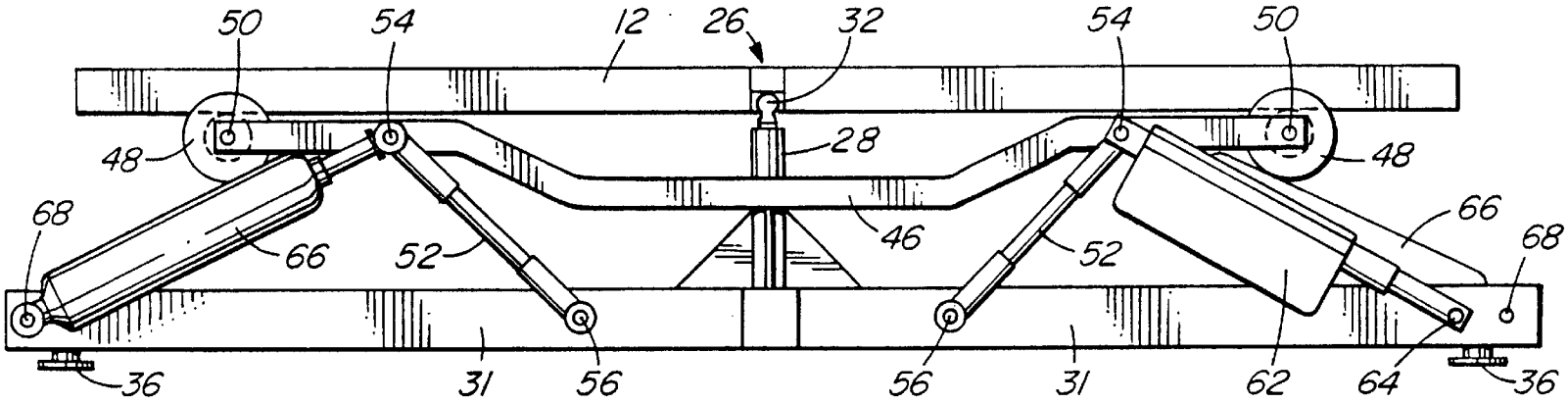
FIG. 5 is a side view of the tilting mechanism shown in FIG. 4 illustrating one of the movable frames with the platform in the horizontal position.
Figure 6:
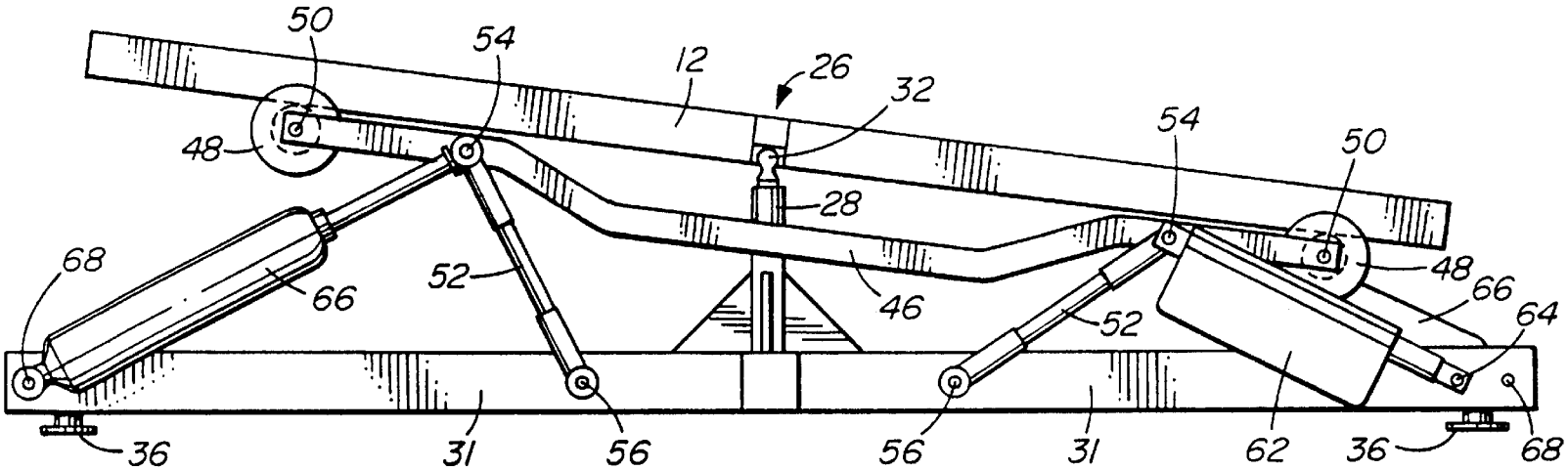
FIG. 6 is a side view similar to that shown in FIG. 5 with the flat platform sloped to the right.
Figure 7:
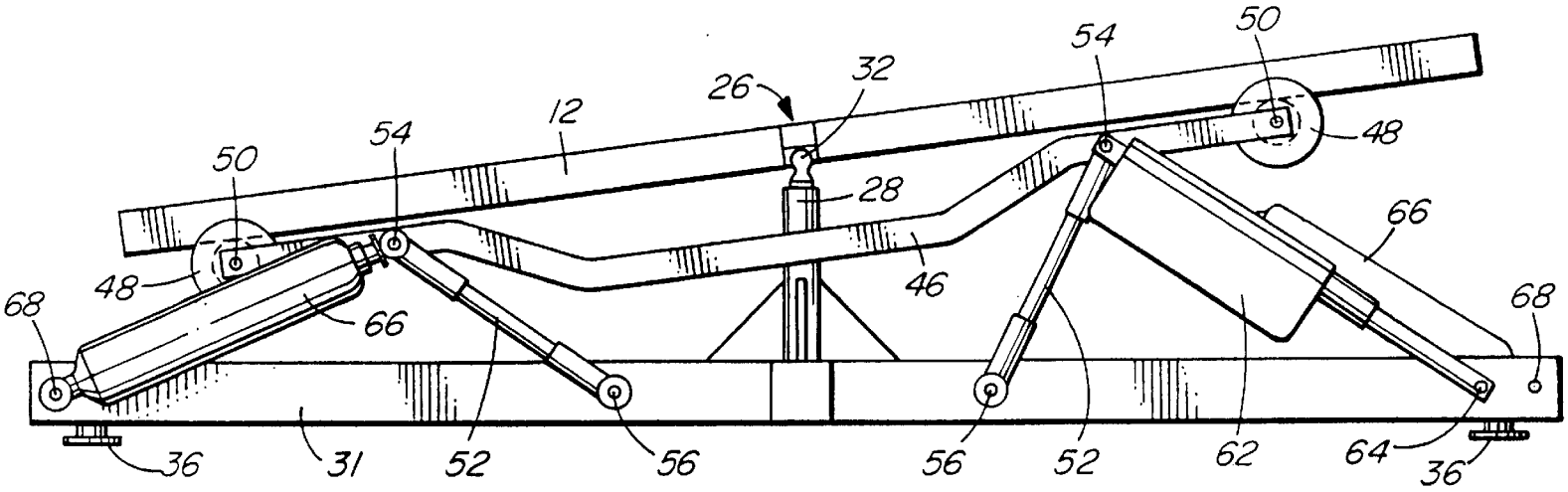
FIG. 7 is a side view similar to that shown in FIG. 5 with the flat platform sloped to the left.

Whereas FIGS. 5, 6 and 7 illustrate the second movable frame 46 moving in one plane, it will be understood that the identical mechanism applies to the first movable frame 40. The second movable frame 46 has the arms depressed at the centre to avoid contact with the arms of the first movable frame 40.

The linear actuator mechanisms each comprise an electric motor with worm gear that rotate a nut on a screw shaft. The mechanisms are self-locking, thus cannot be moved by pushing down on the platform. Rotation of the nut either retracts or extends the actuator arm. FIG. 5 illustrates the platform 12 in a substantially horizontal position to the base 30. The actuator 62 for this position is at approximately the half way point. When the actuator 62 is retracted to the fully retracted position as shown in FIG. 6, the second movable frame 46 is pulled towards the actuator 62 this causes the rollers 48 to rotate on the second guide track 24 underneath the platform 12, and at the same time the pair of linkage arms 52 adjacent the actuator 62 move the second frame 46 downwards and the pair of linkage arms 52 on the other side of the second frame 46 from the actuator 62 moves upwards so that the platform 12 slopes down toward the actuator 62 as shown in FIG. 6.

When the actuator 62 moves to its fully extended position, then the reverse movement occurs, the rollers 48 rotate in the opposite direction on the second guide track 24 of the frame 12, the pair of linkage arms 52 adjacent the actuator 62 pivot up and the pair of linkage arms 52 on the other side of the frame 46 from the actuator 62 pivot down causing the platform 12 to tilt in the opposite direction as can be seen in FIG. 7. The dampers 66 prevent the platform 12 vibrating or shuddering and provide a smooth movement. The dampers 66 also retain the platform stationary and still when it is not tilting so that golfers can swing without feeling that the platform is unstable.

FIGS. 5, 6 and 7 show one plane of movement for the second movable frame 46. The first movable frame 40 has another plane of movement, the actual movement is substantially the same as that shown in FIGS. 5, 6 and 7, therefore the platform 12 can tilt in two planes which when combined allows tilting in any direction. In the embodiment shown, the tilting angle in the planes of the first movable frame 40 and the second movable frame 46 is approximately 7°, and this provides an angle of about 11° for slopes between the first movable frame 40 and the second movable frame 46.

Figure 8:
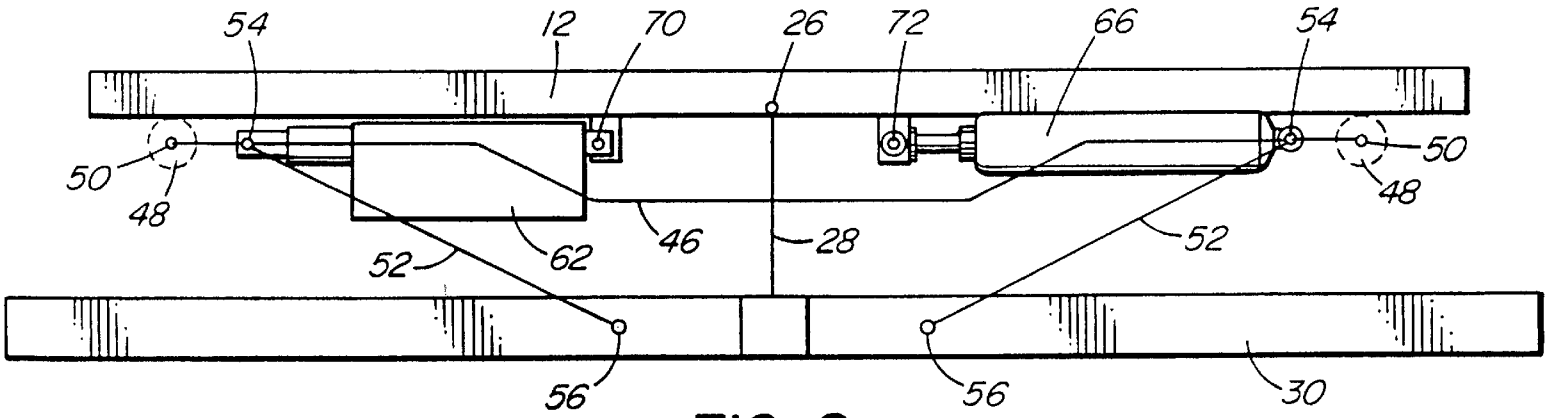
FIG. 8 is a side view showing another embodiment of a tilting mechanism for a tiltable platform with linear actuators and dampers located between the underside of the platform and the movable frame.

Another configuration of a tilting mechanism is illustrated in FIG. 8. This mechanism is substantially the same as that shown in FIG. 4, 5, 6 and 7 except the linear actuator 62 instead of being connected between the second movable frame 46 and the base 30 is connected between the second movable frame 46 and a fixed position 70 on the underside of the top platform 12. Thus, the actuator 62 moves the second movable frame 46 so that the rollers 48 rotate in the second guide track 24 on the underside of the platform 12 and at the same time the pairs of linkage arms 52 move downwards on one side and upwards on the other side so that platform 12 tilts in the same manner as that shown in FIGS. 6 and 7. Similarly, dampers 66 are also attached between the second movable frame 46 and a fixed position 72 on the underside of the platform 12. The actuator 58 for the first movable frame 40 is attached in the same way.

Figure 9:
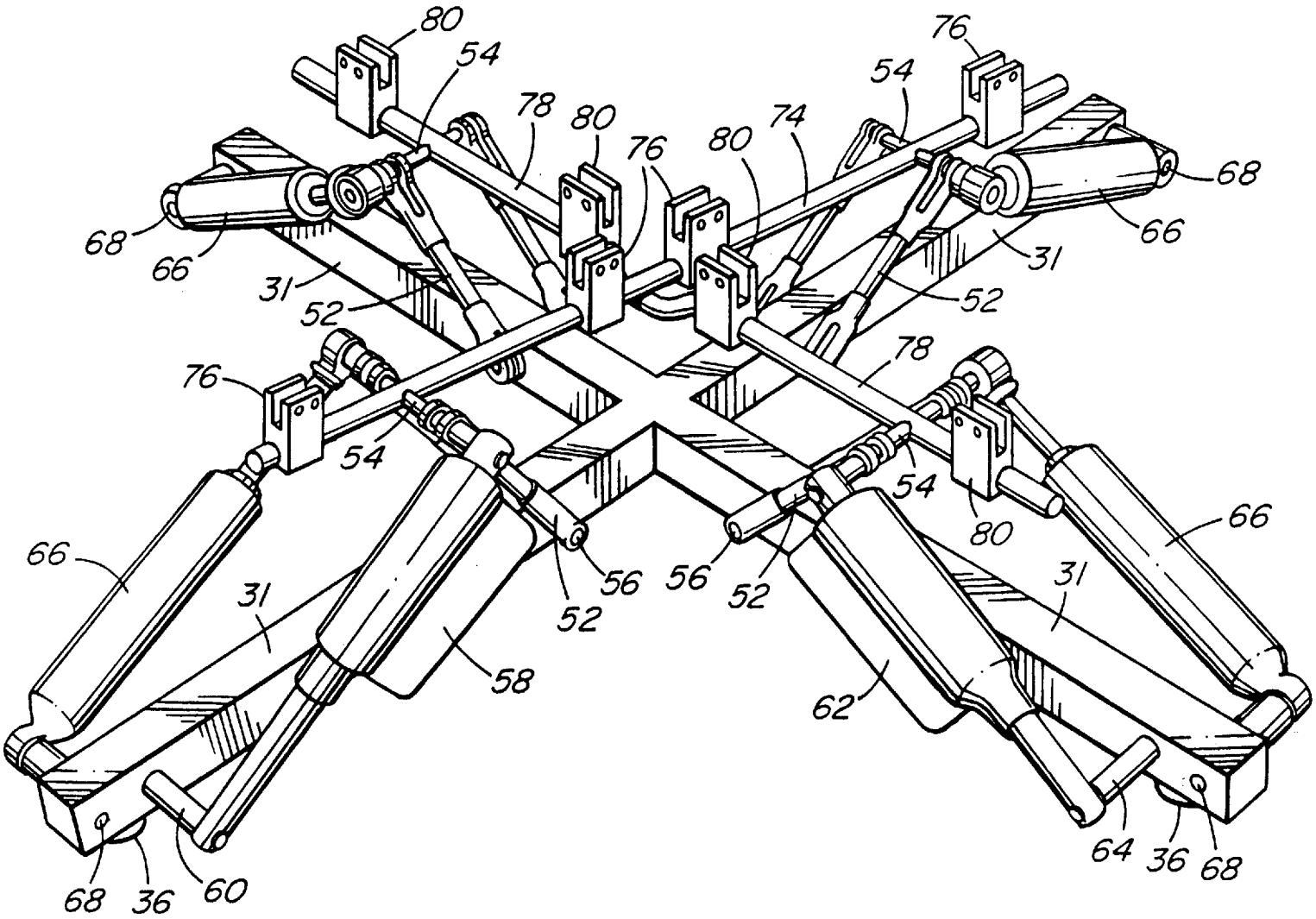
FIG. 9 is an isometric view showing another embodiment of the tilting mechanism without a central pivot.
Figure 10:
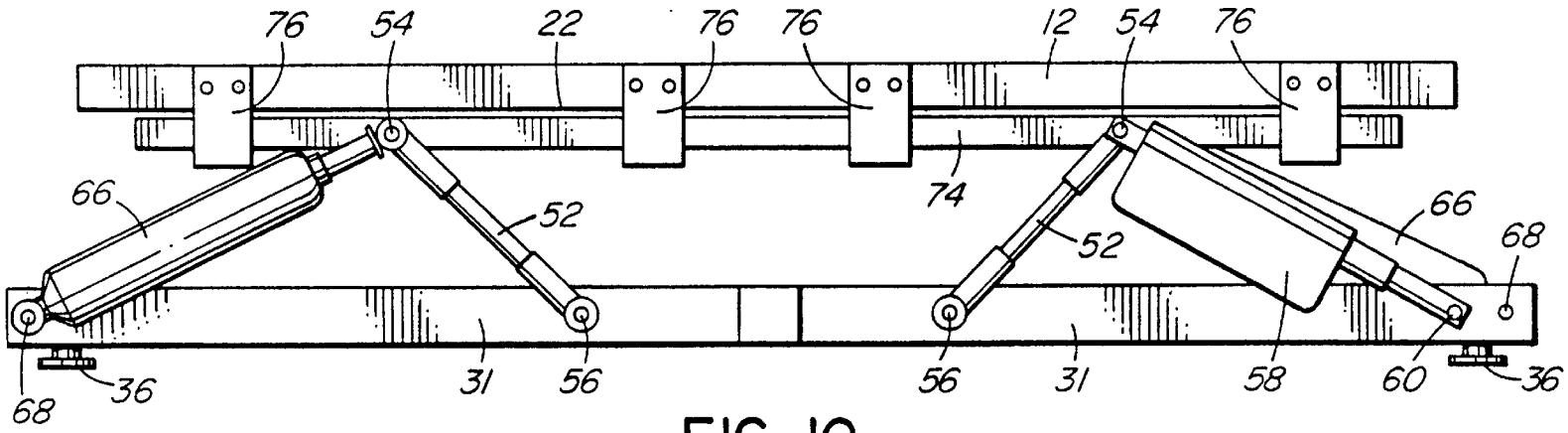
FIG. 10 is a side view of the tilting mechanism shown in FIG. 9 illustrating one of the slidable frame members with the platform in the horizontal position.

Another configuration of a tilting mechanism is shown in FIGS. 9 and 10 which avoids having to have the centre pivot connection 26. A first slidable frame member 74 is parallel with the first guide track 22 on the underside of the platform. The first frame member 74 is preferably a round box or tube and slides and rotates in four first bearing guides 76 which are attached to the first guide track 22 on the underside of the platform 12 as shown in FIG. 10. Whereas four first bearing guides 76 are shown, more or less may be used depending upon the size and weight of the platform 12. The first frame member 74 slides back and forth in a first path when the first actuator 58 expands and contracts. Movement of the first actuator 58 causes the first frame member 74 and hence the platform 12 to tilt.

A second frame member 78 is shown in FIG. 9 parallel to the second guide track 24. The second frame member 78 is level with the first frame member and has a depressed centre portion similar to the depressed portion of the second movable frame 46 shown in FIG. 4. The second frame member slides and rotates in second bearing guides 80 attached to the second guide track 22 on the underside of platform 12.

When the platform tilts, the first frame member 74 and the second frame member 78 act as pivots for the two planes. Thus there is no need to have a centre pivot point 26 as shown in the previous embodiments. The operation of the first and second actuators 58,62 and the dampers 66 acts in the same manner as the previous embodiments as does the outwardly sloped linkage arms 52.

Figure 11:
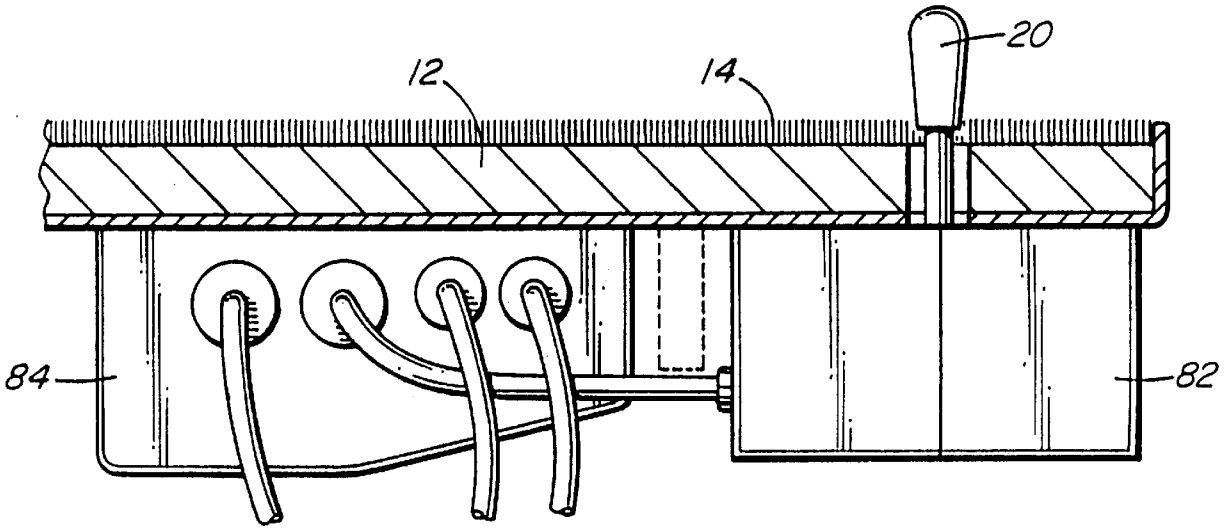
FIG. 11 is a partial sectional view showing a joy stick control to tilt the flat platform.

FIG. 11 shows the control mechanism wherein the joy stick 20 has a switch box 82 positioned beneath the stick 20 and is joined to a control box 84 which provides electrical signals to the two linear actuators 58,62.

In one embodiment the electrical power to the platform is through a coin or token operated box to limit time for each user. Furthermore, the operation of the actuators 58,62 may be connected with a programable control such as a computer for combination with indoor golf nets and simulation screens. The slope of the platform 12 may be set using the slope detectors 29. The deep pile fibre matting panels 16 shown in FIG. 1 may be replaced with, for example, with sand fibre matted panels to simulate sand traps. Alternatively, tee positions may be included either in the deep pile fibre matting panels 16 or, alternatively, without such panels.

Various changes may be made to the embodiments shown herein without departing from the scope of the present invention which is limited only by the following claims.

We claim:

1. A powered tiltable platform comprising:

a platform having a first guide track and a second guide track arranged in a cruciform configuration thereunder with a centre intersection;

a base positioned underneath the platform having support members underneath the first guide track and the second guide track of the platform;

a first frame member beneath and in line with the first guide track, retained to the platform and slidable relative to the platform in a first path parallel to the first guide track;

first opposite sloped linkage arms joining the first frame member to the support members of the base on each side of the centre intersection of the platform;

a first adjustable linear actuator on one side of the first frame member, the first actuator having a fully extended position when the first sloped linkage arms tilt the platform to a maximum slope away from the first actuator, and a fully retracted position when the first sloped linkage arms tilt the platform to a maximum slope towards the first actuator;

a second frame member beneath and in line with the second guide track, retained to the platform and slidable in a second path parallel to the second guide track;

second opposite sloped linkage arms joining the second frame member to the support members of the base on each side of the centre intersection of the platform;

a second adjustable linear actuator on one side of the second frame member, the second actuator having a fully extended position when the second sloped linkage arms tilt the platform to a maximum slope away from the second actuator, and a fully retracted position when the second sloped linkage arms tilt the platform to a maximum slope towards the second actuator, and an operating control for the first actuator and the second actuator to adjust the slope of the platform.

2. The powered tiltable platform according to claim 1 wherein the first frame member slides in first bearing guides attached to the underside of the platform on the first guide track, the first frame member rotatable relative to the first bearing guides, and the second frame member slides in second bearing guides attached to the underside of the platform on the second guide track, the second frame member rotatable relative to the second bearing guides.

3. The powered tiltable platform according to claim 1 including dampers attached to the first movable frame member and the second movable frame member to damp the tilting of the platform and retain the platform stationary when not tilting.

4. The powered tiltable platform according to claim 1 wherein the first frame member and the second frame member are retained to the platform by a pivot connection at the centre intersection on the underside of the platform connected to a post support extending up from the base.

5. The powered tiltable platform according to claim 1 wherein the first actuator is connected between the base and the first movable frame member, and the second actuator is connected between the base and the second movable frame member.

6. The powered tiltable platform according to claim 1 wherein the first adjustable linear actuator and the second adjustable linear actuator are motorized with a worm gear operation to rotate a threaded shaft.

7. The powered tiltable platform according to claim 1 wherein the platform forms a golf practice stand and has a stance portion in the middle thereof with panels of deep pile fibre matting on each side for retaining a golf ball thereon when the platform is tilted.

8. The powered tiltable platform according to claim 7 wherein the maximum angle of tilt in each plane of the first actuator and the second actuator is approximately 7°.

9. The powered tiltable platform according to claim 7 wherein the operating control for the first actuator and the second actuator is a joy stick on the platform operable by movement with a golf club or a foot of a golfer.

10. The powered tiltable platform according to claim 1 wherein the support members of the base have a cruciform configuration matching the cruciform configuration of the first guide track and the second guide track.

11. The powered tiltable platform according to claim 10 including height adjustable pads on the support members of the base.

12. The powered tiltable platform according to claim 1 wherein the first sloped linkage arms and the second sloped linkage arms slope outwards from the base away from the post support.

13. The powered tiltable platform according to claim 1 wherein at least one slope detector is positioned on the platform to provide signals representing slope of the platform in all planes.

14. The powered tiltable platform according to claim 1 wherein the first guide track and the second guide track are in planes 90° apart.

15. A powered tiltable platform comprising:

a platform having a central pivotal connection underneath with a first guide track and a second guide track arranged in a cruciform configuration underneath the platform, the central pivotal connection at the centre of the cruciform configuration;

a base positioned underneath the platform having support members underneath the first guide track and the second guide track of the platform and a post support extending up from the base to the central pivotal connection to support the platform for tilting in any direction;

a first movable frame beneath and in line with the first guide track, having a first guide at each end of the first frame to engage the first guide track on each side of the central pivotal connection;

first opposite sloped linkage arms joining the first frame to the support members of the base on each side of the post support;

a first adjustable linear actuator on one side of the first frame, the first actuator having a fully extended position when the first guide at each end of the first frame tilts the platform to a maximum slope away from the first actuator, and a fully retracted position when the first guide at each end of the first frame tilts the platform to a maximum slope towards the first actuator;

a second movable frame beneath and in line with the second guide track, having a second guide at each end of the second frame to engage the second guide track on each side of the central pivotal connection;

second opposite sloped linkage arms joining the second frame to the support members of the base on each side of the post support;

a second adjustable linear actuator on one side of the second frame, the second actuator having a fully extended position when the second guide at each end of the second frame tilts the platform to a maximum slope away from the second actuator, and a fully retracted position when the second guide at each end of the second frame tilts the platform to a maximum slope towards the second actuator, and an operating control for the first actuator and the second actuator to adjust the slope of the platform.

16. The powered tiltable platform according to claim 15 wherein the guides are concave rubber rollers to engage the first guide track and the second guide track.

17. The powered tiltable platform according to claim 15 wherein the first movable frame has a pair of linear arms which are parallel and evenly spaced apart and the second movable frame has a pair of linear arms evenly spaced apart with deflected portions extending below the first movable frame to avoid contact with the first movable frame.

18. The powered tiltable platform according to claim 15 including dampers attached to the first movable frame and the second movable frame to damp the tilting of the platform, and retain the platform stationary when not tilting.

19. The powered tiltable platform according to claim 15 wherein the post support extending up from the base has a ball joint at the top thereof.

20. The powered tiltable platform according to claim 6 wherein the first actuator is connected between the underside of the platform and the first movable frame and wherein the second actuator is connected between the underside of the platform and the second movable frame.

21. The powered tiltable platform according to claim 15 wherein the first actuator is connected between the base and the first movable frame and wherein the second actuator is connected between the base and the second movable frame.

22. A method of tilting a platform having a first guide track and a second guide track thereunder arranged in a cruciform configuration with a centre intersection, a first frame member and a second frame member retained to the platform and slidable in paths parallel to the first guide track and the second guide track respectively, and first and second opposite sloped linkage arms joining the first and second frame members respectively to a base, the method comprising the step of:

sliding the first frame member and the second frame member in the respective paths so the first and second linkage arms tilt the platform in planes corresponding to the cruciform configuration of the first and second guide track.

23. The method of tilting a platform according to claim 22 wherein first frame member and the second frame member are slid by a first linear actuator and a second linear actuator respectively from fully extended actuator positions representing maximum platform slopes away from each of the actuators and fully retracted actuator positions representing maximum platform slopes towards each of the actuators.

* * * * *